US007491277B2

(12) United States Patent
Hoffman et al.

(10) Patent No.: US 7,491,277 B2
(45) Date of Patent: Feb. 17, 2009

(54) METHOD OF MAKING COLD ROLLED FULL HARD STEEL STRAPPING

(75) Inventors: Kenneth A. Hoffman, Deerfield, IL (US); Dennis A. Miller, Schaumburg, IL (US); Jon E. VanHouten, Valparaiso, IN (US)

(73) Assignee: Illinois Tool Works Inc., Glenview, IL (US)

( * ) Notice: Subject to any disclaimer, the term of this patent is extended or adjusted under 35 U.S.C. 154(b) by 317 days.

(21) Appl. No.: 11/279,147

(22) Filed: Apr. 10, 2006

(65) Prior Publication Data

US 2007/0235112 A1 Oct. 11, 2007

(51) Int. Cl.
*C21D 7/02* (2006.01)
*C21D 7/13* (2006.01)

(52) U.S. Cl. ..... 148/599; 148/603

(58) Field of Classification Search ..... 148/320, 148/603, 332–335, 599; 420/108, 112, 123, 420/128

See application file for complete search history.

(56) References Cited

U.S. PATENT DOCUMENTS 3,421,951 A * 1/1969 Shelton ..... 420/8
5,656,103 A * 8/1997 Roberts ..... 148/320
6,635,127 B2 * 10/2003 Doonan et al. ..... 148/320
6,814,817 B2 * 11/2004 Van Houten et al. ..... 148/320

FOREIGN PATENT DOCUMENTS

JP 2004-359973 * 12/2004

OTHER PUBLICATIONS

Computer-generated English translation of Japanese patent 2004-359973, Masaharu Oka, Dec. 24, 2004.*

* cited by examiner

*Primary Examiner*—Deborah Yee
(74) *Attorney, Agent, or Firm*—Mark W. Croll; Donald J. Breh; Levenfeld Pearlstein, LLC

(57) ABSTRACT

A cold rolled full hard steel strap usable in a strapping machine has a tensile strength of at least about 125.7 thousand pounds per square inch (KSI) when the strap has a width of about 0.500 inches and a thickness of 0.020 inches. The steel strap is fabricated from a coiled steel formed by hot mill rolling and reduced by cold rolling. The steel strap has a composition of approximately (in weight percent): 0.02 to 0.25 percent carbon, 0.15 to 1.50 percent manganese, 0.01 to 0.12 percent aluminum, 0.04 to 0.03 percent nitrogen, 0.04 to 0.50 percent copper, 0.03 to 0.25 percent nickel, 0.02 to 0.25 percent molybdenum, 0.03 to 0.25 percent chromium, maximum 0.05 percent phosphorous, maximum 0.05 percent sulfur, and maximum 0.25 percent silicon. A method for forming the strap also is disclosed.

1 Claim, No Drawings

METHOD OF MAKING COLD ROLLED FULL HARD STEEL STRAPPING

BACKGROUND OF THE INVENTION

The present invention pertains to steel strap. More particularly, the present invention pertains to a composition of a cold rolled full hard steel strap and a method of making strap for use in strapping machines for providing a tensioned loop about packaged articles.

Articles are often packaged in a bundle, on a pallet or in a crate for shipping, storage and merchandising. Many times, such bundled articles are secured with a steel or polymer strap applied in a tensioned loop by an automatic or manually operated strapping machine. Some applications, and in particular those applications in which the strap secures a package having substantial weight, such as a stack of bricks, lumber and the like, require the use of a steel strap which has high tensile strength and is less susceptible to deterioration by abrasion than polymer and existing metal strap. Further, although certain existing steel strap is readily applicable to heavy packaged articles having cylindrical shapes and otherwise smooth or obtuse surfaces, there are limitations on the extent to which it can be formed under tension over and around sharp edges and corners of a package.

More specifically, packages having sharp edges or corners with a small radius of curvature, for example a 90° corner, pose a problem for existing steel strap because the strap is subject to tremendous stress and strain as the strap tension is increased to an extent necessary to secure the packaged article. This stress and strain frequently causes the strap to fracture proximate to the edge or corner of the packaged article. In particular, the relatively low ductility of non-heat treated strap contributes to the failure of strap used in this application. Moreover, the problem is exacerbated when the strap is applied and tensioned with an automatic strapping machine that generates a high tension in a short time interval during a rapid strap application process.

Many practices have been developed to reduce strap failure, such as reducing the tension applied to the strap or placing a shield between the articles to be bundled and the strap. However, reducing strap tension may result in insecurely packaged articles and the use of shields requires an additional step that is time consuming and can be labor intensive, thus increasing costs. As such, these practices are not practical for long term, cost efficient strapping operations.

Crystalline metals, such as steel, are comprised of lattice structures that include imperfections, or "dislocations". Three types of such imperfections, well known in the prior art, are vacancies, interstitial atoms and substitutional atoms (collectively known as "point defects"). In most conventional steel products, including steel strap, such imperfections traditionally have been deemed undesirable because, while the existence of such imperfections generally helps increase strength in cold rolling applications, the imperfections also detrimentally affect the steel's formability and ductility in such applications, and result in the need for subsequent heat treatment after cold rolling to restore formability and ductility.

Strain hardening, such as cold rolling during cold reduction, is one of the most commonly used means of strengthening steel and is well known in the prior art. In traditional cold rolling of steel products, cold reduction is done primarily to achieve a thinner gauge steel than can be otherwise obtained directly from hot mill rolling. However, cold reduction also increases imperfections as a result of plastic deformation and yields a very brittle and unformable steel sheet, which typically must be subsequently annealed, or "heat treated," to remove the hardening caused by the imperfections created, and deformed, by the cold reduction. Thus, the prior art has focused on improving the formability of steel by reducing such imperfections rather than by intentionally increasing them.

Typical standard steel strapping (non-heavy duty strapping) is manufactured by cold reduction with no subsequent annealing (full hard). In the absence of the annealing process, desirable physical strapping properties, such as tensile strength and formability, are developed through other means, such as the chemical composition of the steel, the finishing and coiling temperatures, and the amount of cold reduction.

With respect to chemical composition, iron-based materials suitable for steel strap generally include carbon which is added to the steel to increase the tensile strength of the strap. The addition of carbon, however, creates interstitial imperfections and tends to increase embrittlement, which decreases formability and, accordingly, the ability of steel strap to be formed over and around corners without fracturing.

The prior art also teaches the addition to, or removal of, other elements in a steel's composition to impart various desired physical properties. However, the combination and amount of such elements also controls the types of point defects that are formed, and can enhance the desired physical properties, such as tensile strength, through solution hardening. For example, aluminum and silicon, generally added to remove excess oxygen and nitrogen, both create substitutional imperfections, which help increase strength.

Substitutional imperfections also are formed when alloying various elements with steel. Manganese and nickel, typically added to increase a steel's tensile strength (and, in the case of manganese, to react with sulfur), create substitutional imperfections by replacing iron atoms in the steel crystalline lattice structure. Chromium, which is added to increase hardness and melting temperature, also creates substitutional imperfections. Molybdenum, added to help harden a steel, creates substitutional imperfections. Copper, also generally added to increase hardness, creates substitutional imperfections. Atoms of the foregoing elements in the steel crystalline lattice structure distort the steel crystals, impeding slip and increasing the yield strength of the steel.

Finally, while sulfur, nitrogen, and phosphorus tend to make steel more brittle, and these elements generally are removed or minimized, their presence in controlled amounts also creates substitutional imperfections that may increase strength.

Similarly, control of the finishing and coiling temperatures during hot mill rolling is known in the prior art as an important factor in determining the tensile strength of a steel. Also known in the prior is that the reduction of steel by cold working increases the steel's tensile strength, as discussed above. As such, reduction of steel by cold working allows the carbon content can be reduced while still maintaining a fixed tensile strength. However, the reduction of steel by cold working also increases steel embrittlement and decreases steel formability. In applications where steel formability is important, therefore, reduction by cold working has been performed to a limited extent to avoid embrittlement and the consequent loss in steel formability, and often is complemented by heat treatment (annealing) to restore formability. This adds time and cost to the steel production process.

Accordingly, there is a need for a high tensile strength steel material suitable for use in making steel strap. Desirably, such a strap material exhibits a high tensile strength without the undesirable properties of reduced ductility and increased brittleness as commonly occur in association with the manufacture prior art steel strap materials. More desirably, such a strap is manufactured by cold reduction with no subsequent annealing. Most desirably, such a strap material provides increased tensile strength as a result of intentionally created imperfections in the steel crystalline lattice structure.

BRIEF SUMMARY OF THE INVENTION

A cold rolled full hard steel strap usable in a strapping machine has a tensile strength of at least about 125.7 thousand pounds per square inch (KSI) when the strap has a width of about 0.500 inches and a thickness of 0.020 inches.

The steel strap is fabricated from a coiled steel formed by hot mill rolling and reduced by cold rolling. The steel strap has an approximate composition of (in weight percent): 0.02 to 0.25 percent carbon, 0.15 to 1.50 percent manganese, 0.01 to 0.12 percent aluminum, 0.04 to 0.03 percent nitrogen, 0.04 to 0.50 percent copper, 0.03 to 0.25 percent nickel, 0.02 to 0.25 percent molybdenum, 0.03 to 0.25 percent chromium, maximum 0.05 percent phosphorous, maximum 0.05 percent sulfur, and maximum 0.25 percent silicon.

A method for making the high strength strap includes the steps of forming a steel having a composition of approximately 0.02 to 0.25 percent carbon, 0.15 to 1.50 percent manganese, 0.01 to 0.12 percent aluminum, 0.04 to 0.03 percent nitrogen, 0.04 to 0.50 percent copper, 0.03 to 0.25 percent nickel, 0.02 to 0.25 percent molybdenum, 0.03 to 0.25 percent chromium, maximum 0.05 percent phosphorous, maximum 0.05 percent sulfur, and maximum 0.25 percent silicon, heating the steel to a temperature greater than the $Ac_3$ temperature, hot mill rolling the steel with a finishing temperature of no more than approximately 1150° F., and cold reducing the steel by a minimum of approximately 50 percent.

Increased tensile strength is achieved through a steel composition and method of manufacture that intentionally creates imperfections in the steel crystalline lattice structure. These imperfections undergo plastic deformation during cold reduction and result in increased tensile strength without the need for subsequent annealing. Significantly, the intentional use of imperfections to increase tensile strength in the cold rolled full hard steel of the present invention permits less expensive, lower carbon steel to be utilized, as discussed above, and encourages the use of less expensive scrap materials, which generally contain higher levels of imperfection-causing elements, as the recycled source of the steel.

These and other features and advantages of the present invention will be apparent from the following detailed description, in conjunction with the appended claims.

DETAILED DESCRIPTION OF THE INVENTION

While the present invention is susceptible of embodiment in various forms, the hereinafter described presently embodiments are described with the understanding that the present disclosure is to be considered an exemplification of the invention and is not intended to limit the invention to the specific embodiments illustrated. It should be further understood that the title of this section of this specification, namely, "Detailed Description Of The Invention", relates to a requirement of the United States Patent Office, and does not imply, nor should be inferred to limit the subject matter disclosed herein.

The present invention comprises a composition and method of making a high tensile strength and highly formable cold rolled full hard steel strap usable in automated and manual strapping machines. The steel strap may be used for securing heavy packages having edges or corners over and around which the steel strap must be formed without fracturing, for example a stack of bricks. In the preferred embodiment, the steel strap has a sectional dimension of approximately 0.500 inches and a thickness of 0.020 inches. The invention, however, is applicable to steel straps having any sectional dimension.

The invention involves preparing a steel of the desired composition, forming a hot band through a hot rolling process with a controlled coiling temperature, and substantially reducing the hot band by cold rolling.

The steel composition of the present invention generally comprises a combination of elements having the following chemistry, which percentages are approximate (in weight percent):

0.02 to 0.25 percent carbon
0.15 to 1.50 percent manganese
0.01 to 0.12 percent aluminum
0.04 to 0.03 percent nitrogen
0.04 to 0.50 percent copper
0.03 to 0.25 percent nickel
0.02 to 0.25 percent molybdenum
0.03 to 0.25 percent chromium
maximum 0.05 percent phosphorous
maximum 0.05 percent sulfur, and
maximum 0.25 percent silicon.

The steel, typically in the form of a slab, is processed in a hot mill where it is hot rolled to form a continuous hot band sheet. During the hot milling process, the steel slab is heated to a temperature above the $Ac_3$ temperature (the phase boundary between ferrite and austenite) for rolling. The $Ac_3$ temperature of the steel composition in the preferred embodiment varies, but generally is approximately 1600° F. In the preferred embodiment of the present invention, the finishing temperature of the hot mill rolling process generally is the range of approximately 1350° F. to 1400° F. After the steel band leaves the finishing stand it is processed by a coiling stand where it is formed into coils at a preferred coiling temperature no greater than approximately 1150° F., and then it is allowed to air cool.

After coiling and air cooling, the coiled steel sheet is reduced by at least 50 percent by cold rolling before fabrication into steel strap. The steel strap optionally may also be galvanized with a zinc paint, by electro-plating or by hot dipping to provide a coating that protects the steel strap from corrosion.

Four (4) samples of strap material manufactured in accordance with the present invention, and eighteen (18) samples of typical standard (non-heavy duty) strapping manufactured by cold reduction with no subsequent annealing, were subjected to tensile strength testing. The strap created in accordance with the present invention had a minimum tensile strength of about 125.7 KSI, compared with an average tensile strength of about 114.1 for the typical standard (non-heavy duty) strapping manufactured by cold reduction with no subsequent annealing. It is believed that the increased tensile strength is the result of the intentional creation of imperfections in the steel crystalline lattice structure caused by the particular composition and manufacturing method of the present invention.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A method of making a cold rolled full hard steel strap usable in a strapping machine, the steel strap fabricated of a steel having a tensile strength of at least about 125.7 KSI when the strap has a width of about 0.500 inches and a thickness of 0.020 inches, consisting of the steps of:

forming a steel consisting essentially of: 0.02 to 0.25 percent carbon, 0.15 to 1.50 percent manganese, 0.01 to 0.12 percent aluminum, 0.03 to 0.04 percent nitrogen, 0.04 to 0.50 percent copper, 0.03 to 0.25 percent nickel, 0.02 to 0.25 percent molybdenum, 0.03 to 0.25 percent chromium, maximum 0.05 percent phosphorous, maximum 0.05 percent sulfur, and maximum 0.25 percent silicon, and a balance of iron;

hot rolling the steel into a continuous sheet of hot band steel at a temperature above the $Ac_3$ temperature and at a finishing temperature in the range of approximately 1350° F. to 1400° F.;

coiling the steel at a coiling temperature of approximately 1150° F.;

allowing the coiled steel to air cool;

reducing the coiled steel at least approximately 50 percent by cold rolling to increase tensile strength;

recoiling the cold rolled sheet without heat treating the sheet; and fabricating the cold rolled sheet into steel straps without heat treating the straps.

* * * * *